US006168118B1

(12) United States Patent
Vancraeynest et al.

(10) Patent No.: US 6,168,118 B1
(45) Date of Patent: Jan. 2, 2001

(54) REINFORCING MAT FOR REINFORCING ASPHALT

(75) Inventors: Yves Vancraeynest, Zwevegem; Johan Veys, Oudenaarde, both of (BE)

(73) Assignee: N.V. Bekaert S.A., Zwevegem (BE)

( * ) Notice: Under 35 U.S.C. 154(b), the term of this patent shall be extended for 0 days.

(21) Appl. No.: 09/341,690

(22) PCT Filed: Feb. 2, 1998

(86) PCT No.: PCT/EP98/00579

§ 371 Date: Jul. 26, 1999

§ 102(e) Date: Jul. 26, 1999

(87) PCT Pub. No.: WO98/35100

PCT Pub. Date: Aug. 13, 1998

(30) Foreign Application Priority Data

Feb. 7, 1997 (BE) ..... 9700120

(51) Int. Cl.[7] ..... B21F 27/08; E01C 11/16

(52) U.S. Cl. ..... 245/5; 245/7; 245/11; 404/70; 404/134

(58) Field of Search ..... 245/2, 6, 8, 7, 245/4, 5, 11; 404/70, 100, 134

(56) References Cited

U.S. PATENT DOCUMENTS

| | | | | |
|---|---|---|---|---|
| 3,145,001 | * | 8/1964 | Bruninga | 245/2 |
| 3,682,419 | * | 8/1972 | Vanderfaeille | 245/2 |
| 4,081,159 | * | 3/1978 | Baldwin | 245/2 |
| 4,309,124 | * | 1/1982 | Bertels | 404/70 |

FOREIGN PATENT DOCUMENTS

| | | |
|---|---|---|
| 0 015 027 | 9/1980 | (EP) . |
| 0 229 416 | 7/1987 | (EP) . |
| 0 429 106 | 5/1991 | (EP) . |
| 0 655 531 | 5/1995 | (EP) . |
| 331 848 | 10/1903 | (FR) . |
| 921 473 | 5/1947 | (FR) . |

* cited by examiner

*Primary Examiner*—Danny Worrell
(74) *Attorney, Agent, or Firm*—Shlesinger, Arkwright & Garvey LLP

(57) ABSTRACT

The invention relates to a reinforcing mat (1) for reinforcing a top layer of a ground, which top layer consists of bitumen, asphalt or a hydrocarbon-containing material of like nature, in which the reinforcing mat (1) is a mat woven with longitudinal wires (2, 3) and provided with reinforcement elements (4) running in the transverse direction of the mat, in which the reinforcement elements (4) consist of helically twisted steel profiled wires of essentially rectangular cross section.

21 Claims, 1 Drawing Sheet

REINFORCING MAT FOR REINFORCING ASPHALT

The invention relates to a reinforcing mat for reinforcing the top layer of a ground or road, which top layer consists of bitumen, asphalt or a hydrocarbon-containing material of like nature, in which the reinforcing mat is a mat woven with longitudinal wires and provided with reinforcement elements running in the transverse direction of the mat.

A reinforcing mat which has been utilized with success for reinforcing asphalt is sold by the applicant. N. V. BEKAERT S.A., under the name "Mesh Track". "Mesh Track" is a galvanized steel wire woven mat or mesh, reinforced at regular intervals by two- or three-wire strands fitted in the transverse direction of the mat. Special methods for embedding a reinforcing mat in asphalt roads are described, for example, in European patent applications 429.106 and 505.010 submitted by N. V. Bekaert S.A.

One important purpose of embedding such a reinforcing mat in asphalt roads is to prevent the formation of cracks and tracks in the asphalt roads.

The formation of cracks and tracks in asphalt roads is prevented by the reinforcing mat, which acts to reinforce the asphalt of the road by absorbing the tensile stresses, while the asphalt transfers the compressive stresses. In addition, the transverse reinforcements provide a better distribution of the loads and the granulated asphalt material gets jammed in the mesh openings of the mat.

OBJECTS AND SUMMARY OF THE INVENTION

It has been determined that the reinforcement elements fitted in the transverse direction of the reinforcing mat function primarily to absorb the tensile stresses caused by the heavy traffic. This prevents the sideways displacement of the asphalt road, thus preventing the formation of cracks in the longitudinal direction of the road.

It is of great importance that the reinforcement elements fitted in the transverse direction of the mat should be sufficiently anchored in the asphalt road to effectively reinforce this road and thus to prevent the formation of cracks and tracks. When the anchoring of the reinforcement elements is improved, it then becomes possible to obtain better reinforcement of the asphalt with the use of less reinforcement material.

The first object of the invention is to provide a new type of reinforcing mat in which reinforcement elements fitted in the transverse direction of the mat produce a very firm anchoring in an asphalt road.

Tests have demonstrated that the use of reinforcement elements consisting of helically twisted steel profiled wires of essentially rectangular cross-section considerably improves the anchoring.

Furthermore it has been determined that the reinforcement elements by preference consist of successive zones of essentially the same length, in which each two successive zones are twisted at an angle of approximately 90° in relation to one another.

In an especially preferred embodiment of the mat according to the invention, each two successive zones of the reinforcement elements are twisted alternately in clockwise and counterclockwise directions relative to one another at an angle of approximately 90°.

One important advantage of the new reinforcing mat according to the invention is that the helically twisted reinforcement elements fitted in the mat function as distance blocks for the mat in the asphalt road which is to be reinforced, and this serves to improve the anchoring even further.

Another important advantage of the new reinforcing mat according to the invention is that the mat according to the invention can easily be rolled up and unrolled. It is of great importance that during rolling up, and particularly also during unrolling, the reinforcement elements should not shift in the transverse direction of the mat.

For the reinforcing mats known up to the present time with reinforcement elements in the form of two- and three-wire strands, however, it has been determined that while the reinforcing mat is being unrolled onto the ground to be covered with asphalt the ends of the strands get caught in one another. This problem is totally avoided with the reinforcing mat according to the invention.

BRIEF DESCRIPTION OF THE DRAWINGS

The invention will be explained in more detail in the following description with reference to the accompanying drawing. In the drawing.

DETAILED DESCRIPTION OF THE INVENTION

Figure 1:
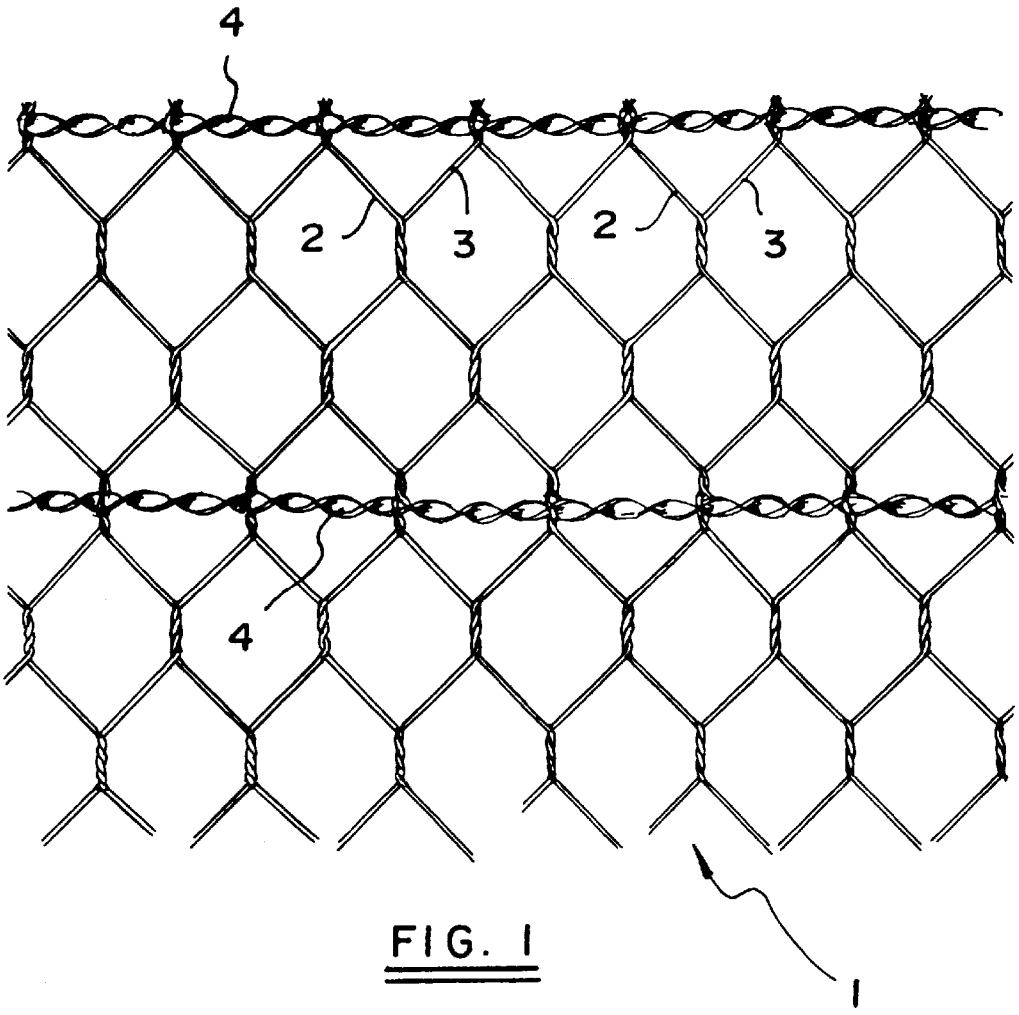
FIG. 1 is a view from above of a reinforcing mat according to the invention.

The embodiment of a reinforcing mat 1 according to the invention shown in FIG. 1 comprises a woven or braided mat with hexagonal meshes. The hexagonal meshes are created by intertwisting two longitudinal wires 2 and 3 with one another, with reinforcement elements 4 being fitted into the torsions at regular intervals transverse to the mat 1.

The reinforcement elements 4 by preference comprise helically twisted steel profiled wires with an essentially rectangular cross-section. The profiled wires 4 are helically twisted around their own axis.

The longitudinal wires 2 and 3 and the reinforcement elements 4 are by preference made of steel wire, with the wires and the reinforcement elements by preference being galvanized. The longitudinal wires 2 and 3 can have, for example, a nominal diameter of 2.2 mm, while the profiled wires 4 have by preference an essentially rectangular cross-section of 2 mm×6.5 mm. The profiled wires 4 are produced, for example, by flat-rolling wires of circular cross-section into bands with a cross-section of approximately 2×6.5 mm. It is obvious that the bands or profiled wires 4 should by preference have rounded edges after rolling.

The hexagonal mesh openings or meshes of the reinforcing mat 1 have, for example, the following dimensions: 118 mm between the torsions in the longitudinal direction and 80 mm between the torsions in the transverse direction. The reinforcement elements or profiled wires 4 are fitted, for example, at a distance of 235 mm from one another. The pitch or the spacing between full revolutions in the twisting of the helically twisted wires or bands 4 is preferably adapted to the distance between the torsions in the transverse direction. This pitch is for example 40 mm, or essentially half of the distance between the torsions in the transverse direction of the mat. This results in the profiled wires 4 being better anchored or fixed in the mat 1. As can be seen in FIG. 1 wires 4 are anchored without fasteners. All of the dimensions given above are intended to serve only as examples.

It is also possible to deform the profiled wires 4 helically by twisting or torquing the wires 4 around their own longitudinal axis, but with the wires 4 displaying an alternating series of torsions, or with the wires 4 displaying alternating left and right revolutions or twisted alternatingly clockwise and counterclockwise.

Figure 2:
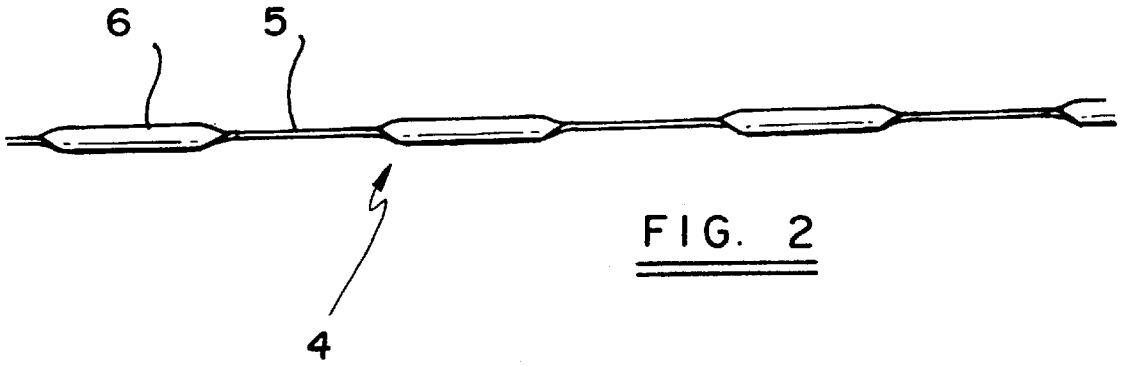
FIG. 2 shows in larger scale a special embodiment of a reinforcement element for a reinforcing mat.

FIG. 2 shows on a larger scale a reinforcement element 4 comprising consecutive zones 5, in which each two consecutive zones 5 and 6 respectively are of essentially the same length, as for example 40 mm, and are twisted at an angle of approximately 90° in relation to one another. It is also possible here that each two succeeding zones 5 and 6 of the profiled wires 4 are twisted alternatingly clockwise and counterclockwise at an angle of approximately 90° with respect to one another.

What is claimed is:

1. Reinforcing mat for reinforcing a top layer of a ground or road, which top layer includes bitumen, asphalt or a hydrocarbon-containing material, in which the reinforcing mat is a mat woven with longitudinal wires and provided with reinforcement elements running in a transverse direction of the mat extending transversely relative to the longitudinal wires, and the reinforcement element including helically twisted steel profiled wires of essentially lar cross-section.

2. Reinforcing mat according to claim 1, wherein the reinforcement elements include successive zones of essentially the same length, and in which each two successive zones are twisted at an angle of approximately 90° in relation to one another.

3. Reinforcing mat according to claim 2, wherein each two successive zones of the reinforcement elements are twisted alternately in clockwise and counterclockwise directions relative to one another at an angle of approximately 90°.

4. A device, comprising:

a) a reinforcing mat for reinforcing a layer of hydrocarbon-containing material disposed on a piece of ground;

b) said reinforcing mat including longitudinal wires;

c) said longitudinal wires including transversely spaced apart first and second longitudinal wires;

d) said first and second longitudinal wires being intertwisted and defining transversely spaced apart torsions;

e) a helically twisted reinforcing element;

f) said helically twisted reinforcing element extending transversely relative to said longitudinal wire;

g) said helically twisted reinforcing element having a substantially rectangular cross section; and h) said helically twisted reinforcing element being fitted into and anchored by at least one of said transversely spaced apart torsions.

5. A device as in claim 4, wherein:

a) said helically twisted reinforcing element includes successive zones;

b) each of said successive zones is about the same length; and c) each one of the said successive zones is twisted at an angle of about 90° relative to the other one of the successive zones.

6. A device as in claim 5, wherein:

a) each one of two successive zones of said helically twisted reinforcing element is twisted alternately in clockwise and counterclockwise directions and at an angle of about 90° relative to each other.

7. A device as in claim 4, wherein:

a) said reinforcing mat is configured for reinforcing one of a layer of bitumen and asphalt disposed on a piece of ground.

8. A device as in claim 4, wherein:

a) said helically twisted reinforcing element is fitted into and anchored by said at least of one of said torsions of said longitudinal wires without the use of a fastener.

9. A device as in claim 4, wherein:

a) said helically twisted reinforcing element is anchored substantially only by said at least of one of said torsions.

10. A reinforcing mat for reinforcing a layer of hydrocarbon-containing material on a piece of ground, said reinforcing mat comprising:

a) a plurality of woven together longitudinal wires;

b) said woven together longitudinal wires defining a plurality of longitudinally and transversely spaced apart torsions;

c) a helically twisted reinforcing element extending transversely relative to said plurality of longitudinal wires;

d) said helically twisted reinforcing element having a substantially rectangular cross section; and e) said helically twisted reinforcing element being fitted into and anchored by at least one of said torsions.

11. A reinforcing mat as in claim 10, wherein:

a) each of said plurality of transversely spaced apart torsions is spaced apart at a predetermined distance relative to each other; and b) a pitch between full revolutions in a twisting of the helically twisted reinforcing element is adapted to a distance between said transversely spaced apart torsions.

12. A reinforcing mat as in claim 11, wherein:

a) the pitch is about half the distance between the transversely spaced apart torsions.

13. A reinforcing mat as in claim 10, wherein:

a) said helically twisted reinforcing element includes successive zones;

b) each of said successive zones is about the same length; and c) each one of said successive zones is twisted at an angle of about 90° relative to the other one of the successive zones.

14. A reinforcing mat as in claim 13, wherein:

a) each one of two successive zones of said helically twisted reinforcing element is twisted in alternately clockwise and counterclockwise directions and at an angle of about 90° relative to each other.

15. A device as in claim 10, wherein:

a) said helically twisted reinforcing element includes successive zones;

b) each one of said successive zones is twisted at an angle of about 90° relative to the other one of the successive zones; and c) each one of two successive zones of said helically twisted reinforcing element is twisted in alternately clockwise and counterclockwise directions and at an angle of about 90° relative to each other.

16. A reinforcing mat as in claim 10, wherein:

a) said longitudinal wires include steel wires.

17. A reinforcing mat as in claim 16, wherein:

a) said helically twisted reinforcing element includes steel wire.

18. A reinforcing mat as in claim 10, wherein:

a) said helically twisted reinforcing element includes rounded edges.

19. A reinforcing mat as in claim 10, wherein:

a) said woven mat includes a plurality of hexagonal openings.

20. A reinforcing mat as in claim 10, wherein:

a) said helically twisted reinforcing element is fitted into and anchored by said at least of one of said torsions of said longitudinal wires without the use of a fastener .

21. A reinforcing mat as in claim 10, wherein:

a) said helically twisted reinforcing element is anchored substantially only by said at least of one of said torsions.

* * * * *

UNITED STATES PATENT AND TRADEMARK OFFICE

CERTIFICATE OF CORRECTION

PATENT NO. : 6,168,118

DATED : January 2, 2001

INVENTOR(S) : Yves Vancraeynest, et al

It is certified that error appears in the above-identified patent and that said Letters Patent is hereby corrected as shown below:

Column 3, line 20, change "element" to ---- elements ----.
Column 3, line 21, after "essentially" change "lar" to ---- rectangular ----.
Column 3, line 44, change "wire" to ---- wires ---.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*